US005642638A

United States Patent [19]

Pietsch et al.

[11] Patent Number: 5,642,638

[45] Date of Patent: Jul. 1, 1997

[54] PROCESS FOR THE ROLLING OF HALLOW INGOTS ON A ASSEL ROLLING MILL

[75] Inventors: Jürgen Pietsch, Mönchengladbach; Ingo Baade, Tünisvorst, both of Germany

[73] Assignee: Mannesmann Aktiengesellschaft, Dusseldorf, Germany

[21] Appl. No.: 518,670

[22] Filed: Aug. 24, 1995

[30] Foreign Application Priority Data

Aug. 24, 1994 [DE] Germany ..... 44 31 410.8

[51] Int. Cl.[6] ..... B21B 19/06

[52] U.S. Cl. ..... 72/98; 72/96

[58] Field of Search ..... 72/7.5, 8.8, 11.5, 72/96, 98

[56] References Cited

U.S. PATENT DOCUMENTS 4,738,128 4/1988 Staat ..... 72/96

5,125,251 6/1992 Pettersson et al. ..... 72/96

FOREIGN PATENT DOCUMENTS 212106 12/1984 Japan ..... 72/96

*Primary Examiner*—Lowell A. Larson

*Attorney, Agent, or Firm*—Cohen, Pontani, Lieberman, Payane

[57] ABSTRACT

The invention relates to a process for reducing the outside diameter and wall thickness by rolling a cylindrical hollow ingot the front part of which is fed into an Assel rolling mill, in which connection, in front of the Assel rolling mill as seen in the direction of feed, a device is provided for reducing the diameter and/or wall thickness of the rear end part of the hollow ingot threaded onto a mandrel rod. In this process, the prereduction rolls are slowly and continuously pressed against the ingot at a predetermined point near the end of the ingot to produce a conically reduced end portion.

14 Claims, 2 Drawing Sheets

PROCESS FOR THE ROLLING OF HALLOW INGOTS ON A ASSEL ROLLING MILL

FIELD OF THE INVENTION

The present invention is related to the fabrication of seamless steel tubes from hollow ingots.

BACKGROUND OF THE INVENTION

Seamless tubes, in particular those made of steel, are produced in three main shaping steps, e.g. piercing, stretching, and finish rolling. Solid round ingots are typically first pierced in a Mannesmann cross rolling mill and later introduced into the so-called sizing or stretcher-reducing mill for finish rolling. Various processes are known for the intermediate stretching, although the instant invention is specifically directed at the Assel process. The Assel process is generally used for the manufacture of tubes of medium and large wall thickness, particularly ones which require excellent surface characteristics and narrow tolerances, such as, for instance, in the manufacture of roller bearing steel pipes. An Assel rolling mill operates in accordance with the principle of cross rolling over mandrel rods, in which three conical work rolls—mounted obliquely at 120 degree angles apart from each other with respect to the rolling axis—are in engagement with the ingot being rolled. Furthermore, the work rolls are displaceable perpendicular to the rolling axis so that a plurality of tube diameters can be produced on an Assel rolling mill. The work rolls of the Assel rolling mill consist essentially of (i) an entry cone, (ii) a working part (the work shoulder), (iii) a smoothing part, and (iv) an exit and rounding part. The smoothing part has the task of partially loosening the tube from the mandrel rod as well as smoothing the surface of the tube, and leveling out differences in wall thickness.

In the rolling of thin-wall tubes in particular, a disadvantage exists in that as a result of the Assel rolling process a trumpet is formed at the rear end of the hollow billet, the trumpet being generally triangular in cross section. The art recognized term for this is triangulation. Triangulation results in a scrap end on the rolled tube which must be cut off. In the case of particularly strong triangulation, the hollow billet can actually remain stuck in the Assel rolling mill, necessitating opening the rolls, resulting in time delays, expenses and other disadvantages.

The cause of triangulation resides in the tendency towards widening of the billet in the rolling mill and is caused by the nature of the Assel process. If the longitudinal tensile stress in the hollow billet decreases towards the rear end of the material being rolled—since sufficient material to be reshaped is no longer present in the entry cone of the Assel rolling mill—the tendency towards an increase in the proportion of the tangential shaping is increased. This means that the radial shaping has a greater impact on tangential shaping and less on longitudinal shaping. In turn this results in an increase in the diameter. If the tangential speed of emergence between the rolls and the mandrel is greater than the entrance speed of the following roll, then there is an accumulation of material in the free spaces between the three rolls which can lead to a blocking of the longitudinal advancement through the mill.

A process of the aforementioned type is known from PCT-WO 90/00449 A1. It has been proposed therein to solve the problems described above by installing on the entry side of the Assel rolling mill a prereduction device which consists of three or four adjustable prereduction rolls, the axes of which have a slight inclination to the axis of the material being rolled or to the axis of the stand of the Assel rolling mill. This angle of inclination can be variable or fixed, and is based on the average angle of advance of the Assel rolling mill. With this known prereduction device, triangulation at the rear end of the hollow billet in the Assel process can be avoided or reduced. The result is that the hollow billet can emerge, disturbance free, from the Assel rolling mill without it being necessary to open the rolls. A reduction in the diameter and/or wall thickness is effected in the prereduction device at the end of the hollow ingot entering the Assel rolling mill. It is therefore the purpose of this prereduction to reduce as much as possible the causative driving force for the widening of the end, namely the radial shaping in the shaping zone of the Assel rolling mill, at least to reduce it to such an extent that there are no longer any disturbances in the Assel rolling mill or high end losses. It would be greatly desirable to optimize the speed and reshaping conditions and thus improve the effect of prereduction in a process of the aforementioned type.

SUMMARY OF THE INVENTION

The present invention relates to a prereduction process for reducing the outside diameter and wall thickness of a seamless tube by rolling a cylindrical hollow ingot, the front part of which is introduced into an Assel rolling mill.

As part of the inventive prereduction process, prereduction means are provided in front of the Assel rolling mill—when viewed in the direction of feed—for reducing the diameter and/or the wall thickness of the rear end part of the hollow ingot which is threaded on a mandrel rod, the prereduction rolls of which reduce the end of the hollow ingot. The prereduction rolls can be pressed against the hollow ingot and moved away from it.

The present invention stems from the recognition that it is not sufficient to simply reduce the ends of the hollow ingots alone before introduction into the Assel rolling mill. Indeed, certain speed and shaping conditions must be maintained so that prereduction does not result in an impairing of the ends of the hollow ingot or, even worse, in elimination of the desired prereduction effect. It has also been found that the conditions are dependent on what pipe diameters and wall thicknesses are to be rolled in the Assel rolling mill.

In accordance with the invention, and in recognition of the known problems and disadvantages as well as inadequacies of existing devices described, it is proposed to apply the rolls of the prereduction device slowly and continuously against the hollow ingot to create a conical region at the end of the ingot in relation to the diameter of the hollow ingot along a length of the axial path to which the prereduction device is applied. If these conditions are observed, optimal results, in line with the intended purpose of the invention, can be obtained. If the path length selected is too short then the rolls of the prereduction device do not reach their end position, which means that the wall thickness is not sufficiently reduced and triangulation occurs. On the other hand, if the reduced length is too long, then a bulge is produced, i.e. a thickening of the hollow ingot at the end, so that a triangulation also can occur there.

In accordance with the instant invention, the prereduction rolls are adjusted slowly and continuously against the hollow ingot with such a speed of adjustment that the axial path ($L_{NEL}$, for the action of the prereduction rolls, measured from the point of impact of the prereduction rolls on the surface of the hollow ingot up to the end of the hollow ingot amounts to $L_{NEL}\approx 0.8$ to 2.0 $D_H$, and preferably in the range $L_{NEL}=1.0$ to 1.25 $D_H$, in which $D_H$ is the outside diameter of the hollow ingot before entry into the Assel rolling mill.

Additionally, the rear end of the hollow ingot should extend as perpendicular as possible to the longitudinal axis. Sawed ingots are preferred. Oblique hollow-ingot ends and large differences in wall thickness at the end also lead to partial (one-sided) triangulation.

In a further development of the invention, it has been found that the diameter of the tangential circle between the rolls of the prereduction device in the applied state is of particular importance. Favorable results have been obtained utilizing the values described hereinbelow.

The diameter of the tangential circle between the prereduction rolls in the adjusted, i.e. applied position, is maintained as follows:

for medium wall thicknesses ($D_L/S_L \leqq 12$)

$$D_{NEL}=D_M+(1.8 \text{ to } 2)\times S_H$$

$$SH_E=(0.9 \text{ to } 1.0)\times S_H; \text{ and}$$

for small wall thicknesses ($D_L/S_L>12$)

$$D_{NEL}=D_M+(2.0 \text{ to } 2.2)\times S_L$$

$$SH_E=(1.0 \text{ to } 1.1)\times S_L; \text{ and}$$

for thin-wall hollow ingots $$D_{NEL}=a+b\times D_{HP}[mm];$$

in which:

$D_{NEL}$ is the diameter of the tangential circle between the prereduction rolls in the adjusted, i.e. applied, position $S_H$ is the wall thickness of the hollow ingot $SH_E$ is the reduced wall thickness on the end of the hollow ingot after application of the prereduction rolls $D_L$ is the diameter of the hollow ingot behind the Assel rolling mill $D_M$ is the diameter of the mandrel rod $S_L$ is the wall thickness of the hollow ingot behind the Assel rolling mill $D_{HP}$ is the diameter of the tangential circle between the Assel rolls at the high point in the operating position and in which:

a=0 to 10, and preferably 6.35 b=0.9 to 1.0, and preferably 0.938.

Together with the aforementioned range for $L_{NEL}$, when the above criteria are observed, one obtains a hollow ingot end which, after a conically extending transition, terminates in a cylindrically extending reduced hollow ingot wall. In the extreme case, the length of the cylindrical part of the hollow ingot end can be zero.

The values $SH_E$ and $D_{HP}$ may be theoretically calculated mathematically or actual values may be used. Such theoretical calculations may lead to extremely slight differences from the values actually obtained. This difference may be caused, for example, by minor vibrations in the mill frame during the rolling process or through the natural resilience of the ingot material. However, the differences between actual and theoretical values are so slight that either may be used without detrimental result and without straying from the spirit of the invention.

In accordance with another feature of the invention, advance angles for the rolls of the Assel rolling mill are indicated which, together with the above-explained features of the invention, also reduce the widening. It has been found that, in addition to the reduction of the wall thickness, the advance angle also effects the widening. This angle must, as far as possible, be sufficiently small, at least for the rolling out of the rear end of the hollow ingot, so that too much material does not enter the roll gap per revolution. A preferred advance angle $\gamma$ of between 3.5 and 6 degrees, yields favorable results. If the advance angle is too small, then the axial exit speed is low, while the excessively small widening occurring thereby makes loosening the hollow billet from the mandrel rod difficult.

In accordance with another feature of the invention, it is proposed to adjust the roll circumferential speed at between 1.5 and 6 meters/second, and preferably between 4.0 and 4.5 meters per second.

It is favorable for the rolling of thin-wall hollow billets if the smoothing part of the Assel roll is relatively short with a large exit angle of the rolls. A preferred range of dimensions for the length of the smoothing parts is related to different hollow ingot diameters. The exit angle, with reference to the smoothing part of the Assel roll, should in this case be 4 to 6 degrees.

For the rolling of thin-wall hollow billets in the case of a short smoothing part, the rolls are produced with a large exit angle, in which connection, with a distance $D_{HP}$ apart of the rolls of the Assel rolling mill at the high point of:

$D_{HP}$=90 to 150 mm, a smoothing part length LK=10 to 50 mm, and preferably LK=20 to 30 mm, is provided;

and with a distance apart of:

$D_{HP}$ 150 to 200 mm a smoothing part length LK=20 to 80 mm, and preferably LK=30 to 40 mm, is provided, the exit angle of the Assel rolls with reference to the smoothing part being between 4 and 6 degrees.

It is preferred that the transition between the smoothing part and exit part is rounded by a radius, so that a sharp edge is avoided. It is also possible to develop the entire outlet part in a curved shape, i.e. to replace the conical or linear part completely by a rounded part.

Finally, in a further development of the measures taken in accordance with the invention, it has proven suitable if, upon the rolling of thin-wall hollow billets, the angle of spread $\delta$ which in traditional divergent Assel mills amounts, for instance, to 3 degrees, is slightly opened, i.e. is increased by 0.3 to 0.7 degrees to 3.3 to 3.7 degrees.

Upon the rolling of thin-wall hollow billets:

$\delta=\delta_{Nom}$+0.0 to 1.5 degrees, and preferably $\delta=\delta_{Nom}$+0.3 to 0.7 degrees, in which $\delta_{Nom}$ is the spread angle determined by the design of the rolling mill for the roll pass design.

Another proposal of the invention provides that, before the closing of the rolls of the prereduction device, the rolls are brought into a position close to the surface of the hollow ingot.

Before the adjustment of the prereduction rolls, the rolls are moved into a position close to the surface of the hollow ingot, in which connection, for the tangential circle of the preadjusted rolls:

$D_{NEL}0=D_H$+4 to 20 mm, and preferably $D_{NEL}0=D_H$+8 to 16 mm.

This preadjustment of the rolls of the prereduction device has the advantage that the rolls represent an additional guide for the hollow ingot upon the rolling in the Assel rolling mill and greater assurance of obtaining the necessary reduced length is obtained.

With a prereduction device which is arranged in front of an Assel rolling mill for the rolling of preferably thin-walled tubes, favorable results can be obtained with the process described above. Triangulation at the end of the rolled hollow ingot can be avoided substantially, or at least reduced to such an extent that it no longer has a detrimental effect on the course of the process.

DESCRIPTION OF THE DRAWING FIGURES

In the drawing figures, which are illustrative and not to scale, and wherein like reference numerals denote like elements throughout the several views:

FIG. 1 is a representational side view of an Assel rolling mill with prereduction rolls upon which the method of the instant invention may be practiced; and FIG. 2 is a partial view of the end of an ingot formed in accordance with the instant invention.

DETAILED DESCRIPTION OF THE PREFERRED EMBODIMENTS

Figure 1:
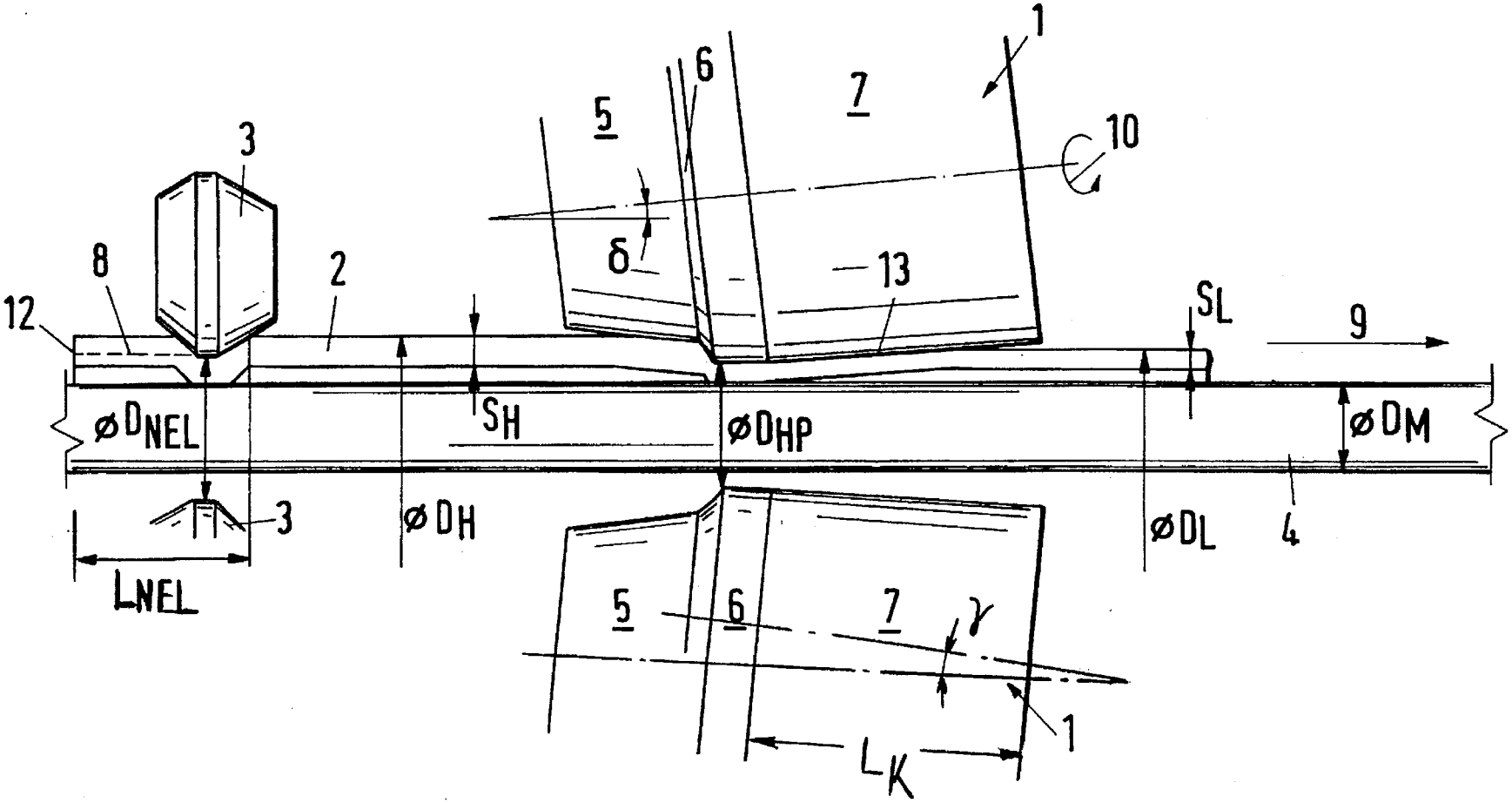
Figure 2:
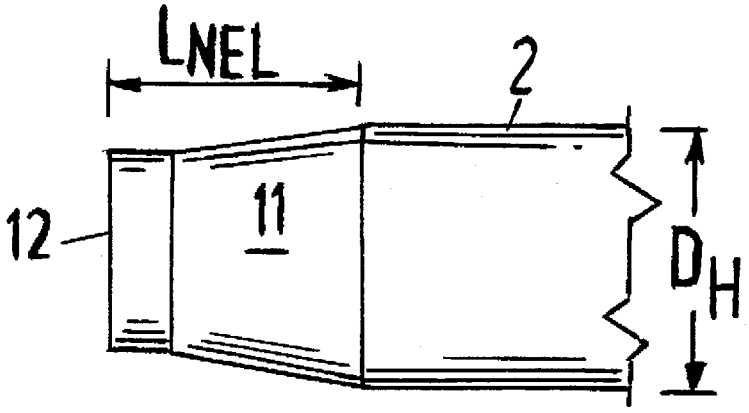

With initial reference to FIGS. 1 and 2, in which two of three Assel rolls designated 1 of an Assel rolling mill can be noted which work the hollow ingot 2 so as to reduce its diameter and wall thickness. In front of the Assel rolls 1 there is arranged the prereduction device, (not completely shown), two rolls of which are designated 3. The mandrel 4 is depicted within the hollow ingot 2. The roll of the Assel rolling mill consists of the entry part 5, the work part (shoulder) 6, the smoothing part 7, and the exit or rounding part 13. The angle of spread of the rolls 1 is designated δ.

The surfaces of the two rolls 3 of the prereduction device which face the rolling axis are contacted in their working position shown in the drawing by a tangential circle which has the diameter $D_{NEL}$. In this connection, the hollow ingot 2 is reduced to an outside diameter which is indicated in dashed line at 8. Upon the advance of the hollow ingot in the advancing direction 9 resulting from the drive of the Assel rolls in the roll drive direction 10, and the adjustment of the rolls 3 of the prereduction device, there is produced a conical region of transition from the outside diameter of the hollow ingot $D_H$ to the diameter $D_{NEL}$ corresponding to the tangential circle, as shown in FIGS. 1 and 2. The conical transition region is designated 11.

The total length between the start of the conical region 11 adjoining the hollow-ingot diameter $D_H$ to the end of the hollow ingot 12 is $L_{NEL}$.

Additionally, and as also shown in FIG. 1, the wall thickness $S_H$, as well as the tangential circle has been entered at the "high point" of the Assel rolls and designated $D_{HP}$. The outside diameter of the hollow billet leaving the Assel rolling mill is designated $D_L$ and the wall thickness of the hollow billet is designated $S_L$. The diameter of the mandrel rod is $D_M$.

An Assel rolling mill in accordance with the invention, such as shown in the drawing figures, can, for instance, have the following dimensions and values:

$D_H$=185.7 mm coming from the piercing mill $S_H$=17.9 mm coming from the piercing mill $D_M$=139.7 mm mandrel rod diameter $D_{HP}$=158 mm distance apart of the Assel rolls at the high point (diameter of tangential circle)

$D_L$=177.8 mm of the hollow billet leaving the Assel rolling mill $S_L$=9.5 mm wall thickness of the hollow ingot leaving the Assel rolling mill γ=4.5 degree advance angle of the Assel rolling mill δ=3.7 degree spread angle of the Assel rolling mill $V_U$ 4.2 mm/sec circumferential speed of the Assel roll at the high point $D_W$=403 mm diameter of the Assel roll at the high point $t_{NEL}$=0.4 sec closing time of the rolls of the prereduction device from the first contact up to the end position.

$D_{NEL}$=155.2 mm preselected distance apart of the rolls (diameter of the tangential circle) of the prereduction device without the action of the shaping force $L_{NEL}$=230 mm path of action of the prereduction device $L_K$=32 mm length of the smoothing part of the Assel roll $D_{NEL}0$=198 mm distance apart of the preadjusted rolls of the prereduction device.

A prereduction device for practicing the process of the invention preferably operates hydraulically. The maximum pressing force of the rolls of the prereduction device is present with given hydraulic cylinders and selection of the pressure. The hydraulic pressure applied is as a rule constant. The closing speed can be adjusted by valve as a function of the amount passing through per unit of time, in which connection one operates with small speeds. The start of the closing process of the rolls of the prereduction device may be triggered by photocells or any other electronic or optoelectronic sensing device; the closing time, however, must be selected as a function of the diameter of the hollow ingot.

It is also conceivable to determine the axial speed in the entry by two sensors and a microprocessor via a time measurement for a defined measurement path. In this way, the start of the closing process can be adapted to the speed. The opening of the rolls of the prereduction device can also be triggered by a photocell or like device.

It should be understood that the preferred embodiments and examples herein described are for illustrative purposes only and are not to be construed as limiting the scope of the present invention, which properly delineated only in the claims appended hereto.

What is claimed is:

1. A method of reducing the outside diameter and wall thickness of a cylindrical hollow ingot having a front end, a back end and an outside diameter, the front end of which is to be fed into an Assel rolling mill, the method comprising:

providing a plurality of prereduction rolls in advance of said Assel rolling mill, the outer surfaces of said rolls being oriented around said ingot in a circular pattern having a diameter;

feeding said ingot at a constant speed through said circle of prereduction rolls; and reducing said diameter so as to advance said prereduction rolls against said ingot proximate said back end at a constant pressure over a desired length of said ingot as measured along the longitudinal axis of said ingot from said back end so as to produce a cone shaped region on said ingot, said desired length being approximately 1.0 to 1.25 times said outer diameter of said ingot.

2. The method according to claim 1, wherein for an ingot having a wall thickness of ($D_L/S_L \leqq 12$), during said reducing step $D_{NEL}=D_M+(1.8 \text{ to } 2)\times S_H$ and $SH_E=(0.9 \text{ to } 1.0)\times S_H$, wherein for an ingot having a wall thickness of ($D_L/S_L>12$), during said reducing step $D_{NEL}=D_M+(2.0 \text{ to } 2.2)\times S_L$ and $SH_E=(1.0 \text{ to } 1.1)\times S_L$, wherein for an ingot that is a thin-wall hollow ingot, during said reducing step $D_{NEL}=a+b\times D_{HP}$, wherein $D_L$ is the diameter of the hollow ingot before reaching the Assel rolling mill, $S_L$ is the wall thickness of the hollow ingot behind the Assel rolling mill, $D_{NEL}$ is said diameter, $D_M$ is the diameter of the mandrel rod, $S_H$ is the wall thickness of the hollow ingot, $SH_E$ is the reduced wall thickness on the end of the hollow ingot after said reducing step, $D_{HP}$ is the diameter of the tangential circle between the Assel rolls of said Assel rolling mill at the Assel rolls' high point in the Assel rolls' operating position, and wherein a=approximately 0 to 10, and b=approximately 0.9 to 1.0.

3. The method according to claim 2, wherein a=6.35 and b=0.938.

4. The method according to claim 2, further comprising rolling said ingot with the rolls of an Assel rolling mill operated with a feed angle of approximately 3 to 14 degrees.

5. The method according to claim 4, wherein said feed angle is approximately 3.5 to 6.0 degrees.

6. The method according to claim 4, further comprising adjusting the circumferential speed of the rolls of the Assel rolling mill to approximately 1.5 to 6.0 meters/second.

7. The method according to claim 6, wherein said circumferential speed is adjusted to approximately 4.0 to 4.5 meters/second.

8. The method according to claim 6, further comprising selecting a smoothing part length and an exit angle of said Assel rolls, wherein for Assel rolls having a high point distance of approximately 90 to 150 mm a smoothing part length of approximately 10 to 50 mm and an exit angle of approximately 4 to 6 degrees is selected, and for Assel rolls having a high point distance of approximately 150 to 200 mm a smoothing part length of approximately 20 to 80 mm and an exit angle of approximately 4 to 6 degrees is selected.

9. The method according to claim 8, wherein for Assel rolls having a high point distance of approximately 90 to 150 mm a smoothing part length of approximately 10 to 50 mm is selected.

10. The method according to claim 8, wherein for Assel rolls having a high point distance of approximately 150 to 200 mm a smoothing part length of approximately 30 to 40 mm is selected.

11. The method according to claim 8, further comprising providing Assel rolls having a spread angle determined by the design of the rolling mill for the roll pass design of approximately+0.0 to 1.5 degrees.

12. The method according to claim 11, wherein said spread angle is approximately+0.3 to 0.7 degrees.

13. The method according to claim 11, further comprising preadjusting said plurality of prereduction rolls into a position closely proximate to the surface of the hollow ingot, said preadjusted position being approximately 4 to 20 mm from said outer diameter of said ingot.

14. The method according to claim 13, wherein said preadjusted position is 8 to 16 mm from said outer diameter of said ingot.

* * * * *